United States Patent [19]

Bechler et al.

[11] Patent Number: 4,699,384

[45] Date of Patent: Oct. 13, 1987

[54] TRAINING DEVICE FOR IMPROVING THE GOLF SWING

[76] Inventors: Jürgen Bechler, Dachauer Strabe 140e, 8000 Müchen 19; Toni Feldmeier, Frauenried 3, 8167 Irschenberg, both of Fed. Rep. of Germany

[21] Appl. No.: 938,036

[22] Filed: Dec. 4, 1986

[30] Foreign Application Priority Data

Aug. 8, 1986 [DE] Fed. Rep. of Germany ..... 3626829

[51] Int. Cl.[4] ..... A63B 69/36

[52] U.S. Cl. ..... 273/186 C; 273/191 R

[58] Field of Search ..... 273/186 R, 186 C, 191 R, 273/191 A, 191 B, 192, 187 R

[56] References Cited

U.S. PATENT DOCUMENTS

| | | | |
|---|---|---|---|
| 2,340,793 | 2/1944 | Chapman | 273/192 |
| 2,790,642 | 4/1957 | Rolfe | 273/187 |
| 2,807,472 | 9/1957 | Hatfield | 273/191 |
| 2,813,721 | 11/1957 | Zega | 273/191 |
| 3,269,733 | 8/1966 | Taddie et al. | 273/192 |
| 3,460,837 | 8/1969 | Cassa | 273/191 R |
| 3,583,707 | 6/1971 | Fujimoto | 273/191 A |
| 3,679,206 | 7/1972 | Shambaugh | 273/32 R |
| 3,776,555 | 12/1973 | Hagaman | 273/186 |
| 4,023,811 | 5/1977 | De Cota | 273/186 R |
| 4,322,084 | 3/1982 | Reece et al. | 273/187 R |
| 4,355,809 | 10/1982 | Swett, Jr. | 273/183 D |
| 4,468,034 | 8/1984 | Duclos | 273/183 D |

*Primary Examiner*—George J. Marlo

*Attorney, Agent, or Firm*—Silverman, Cass, Singer & Winburn, Ltd.

[57] ABSTRACT

The training device for improving the golf swing includes a base provided with spatially positioned guide means for interaction with the face of a golf club head. The base has two rods disposed at an angle to each other, one rod being in the form of an arc segment and the other rod being straight and extending parallel to the target line. The guide means includes an obliquely upwardly extending barrier rail mounted on the arcuate rod and delineating the path of the upstroke of the golf swing.

9 Claims, 6 Drawing Figures

TRAINING DEVICE FOR IMPROVING THE GOLF SWING

FIELD OF THE INVENTION

The present invention relates to a training device for improving the golf swing, which device includes a base support having attached thereto spatially positioned guide means for interaction with the face of a golf club head.

BACKGROUND OF THE INVENTION

The state of the art, such as illustrated in U.S. Pat. No. 2,807,472, includes a training device constructed so that the base in the shape of a supporting frame has affixed thereon a spherically curved member along which the club face is to be guided to aid the golfer in the execution of a proper golf swing. This device is very complex and accordingly expensive and unwieldy to handle.

The prior art further disclosed, in U.S. Pat. No. 2,813,721, a practice device for improving the golf swing in which a frame-like support structure is provided with means defining a closed loop along which the golf club is guided. This prior art device is encumbered with similar disadvantages as the one mentioned above.

Also known from U.S. Pat. No. 3,776,555 is a golf swing training device which utilizes photoelectric means as a boundary and other electronic means for determining the speed of the club head at the moment of impact with the golf ball. This device is also complicated to handle and evaluate so that the rate of successful completion of the learning process is low.

Other golf training devices are known from U.S. Pat. Nos. 2,790,642; 4,322,084; 3,697,206; 4,468,034 and 4,355,809. However, none of these devices has proven suitable to successfully teach novices and advanced beginners the proper execution of the golf swing.

The object of the present invention is therefore a training device of the type generally referred to above, which has a simpler construction than devices of the prior art yet ensures that the golfer learns to execute the golf swing properly and accurately.

SUMMARY OF THE INVENTION

The present invention provides a training device having a supporting base which consists of two rod-like members disposed at an angle to each other. One rod member is in the shape of an arc segment and the other rod member is straight and capable of being disposed parallel to the target line. The guide path is defined by an obliquely upwardly extending rail-like structure which functions as a barrier to contain the upstroke of the golf swing. This barrier rail is mounted on the arc-shaped rod member. This construction makes it possible to control the downstroke of the swing as well as the angle of impact of the club face in a simple and effective manner.

The obliquely upwardly extending barrier or guide rail delineates an imaginary plane within which lies the downstroke of a properly executed golf swing and the angle of impact of the golf club head with the ball. The barrier or guide rail operates to ensure the so-called inside path of travel that the head of a golf club traverses to arrive at the ball and prevents the club face from making contact with the ball from outside of the target line.

According to another embodiment of the invention, the two rod members constituting the base structure may be in the form of hollow tubular members or pipes and the barrier rail is slidably movably mounted on the arcuate rod member and is rotatable about the longitudinal axis of the arcuate rod member. This provides for many different easy adjustments of the device depending on the playing ability and the body build of the golfer.

In another embodiment of the invention, the arcuate rod member has mounted thereon a sleeve provided with arresting means. Radially projecting from the sleeve is another sleeve-shaped member which serves to receive the barrier rail. The arresting means includes a threaded pin having an operating knob. The threaded pin is inserted into the sleeve and is thus adapted to act on the arcuate rod member to simply and efficiently effect quick adjustment of the angular position of the barrier rail with respect to the arcuate rod member so as to allow it to function properly.

Further, according to yet another embodiment of the invention, the straight line rod member extending parallel to the target line has mounted thereon at a right angle a slidably movable orientation rod or stick which serves to aid the golfer in taking his correct stance in addressing the golf ball.

According to still another embodiment of the invention, the straight-line rod member extending parallel to the target line may also have an angularly upwardly extending slidably movable knee rod or stick mounted thereon. This knee stick likewise serves as an additional teaching aid.

In order to make the device as a whole transportable and thus render it versatile for use, according to still another embodiment, the arcuate rod member is secured on a sleeve for receiving and arresting therein the straight-line rod member.

BRIEF DESCRIPTION OF THE DRAWINGS

The invention will be described in further detail with reference to one embodiment of the invention illustrated in the drawings, in which.

DESCRIPTION OF THE PREFERRED EMBODIMENTS

Figure 1:
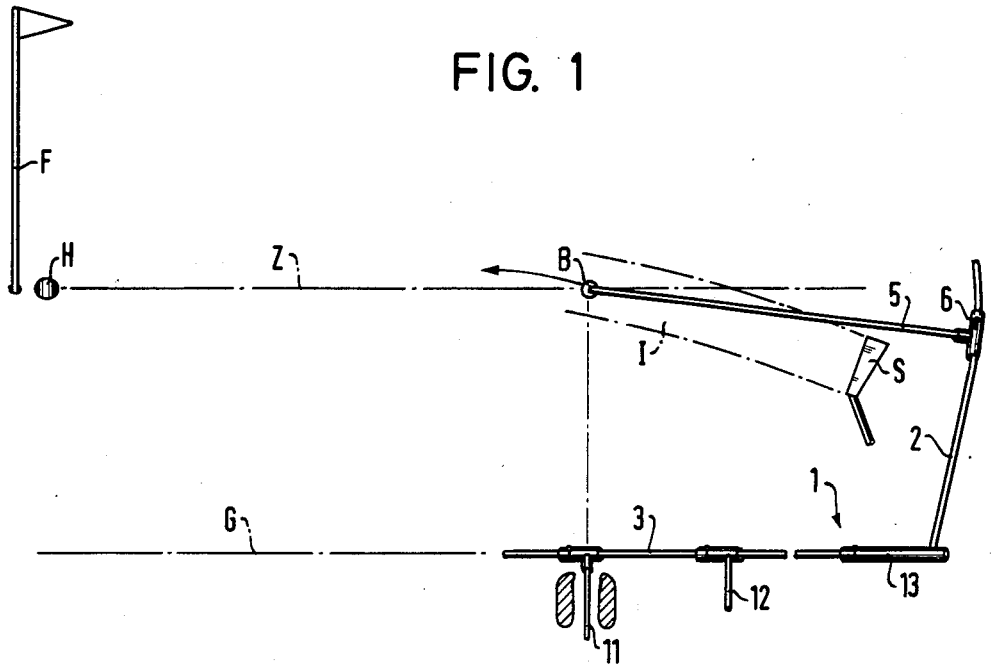
FIG. 1 is a diagrammatic top plan view of the training device of the present invention illustrated in relation to the golf hole.

Referring to FIG. 1, the training device for improving the golf swing of the present invention includes a supporting base 1 and spatially positioned guide means for interaction with the face of a golf club head (not shown). The base 1 is placed on the ground, whereas the guide means which is attached to the base 1 may either extend obliquely upwardly or may also extend along the ground. A golf ball B is placed below the path of the guide means on an imaginary target line Z pointing to a hole H marked by a flag F.

The base 1 of the training device consists of two rod-like members 2 and 3 disposed at an angle to each other. The rod members 2 and 3 may be in the form of solid rods or hollow tubular members or pipes, for example. The rod 2 is in the form of an arc segment 2, and the rod 3 is straight and extends parallel to the target line.

The guide means takes the form of a barrier bar or rail 5 which is mounted on the arc-shaped rod 2 and extends obliquely upwardly. This barrier rail 5 serves to delineate or guide the upstroke curve of the swing. It cuts the target line in the area of the golf ball B to be struck at. The barrier rail 5 may be made of a plastic material or it may also consist of a coated metal bar or the like.

An orientation stick 11 is attached at a right angle to the straight rod 3 on either side of which stick 11 the golfer may place his feet. An obliquely upwardly extending knee stick 12 may also be secured to the straight rod 3, which stick 12 is slidably movable to aid in controlling the operational motion of the golfer.

Figure 2:
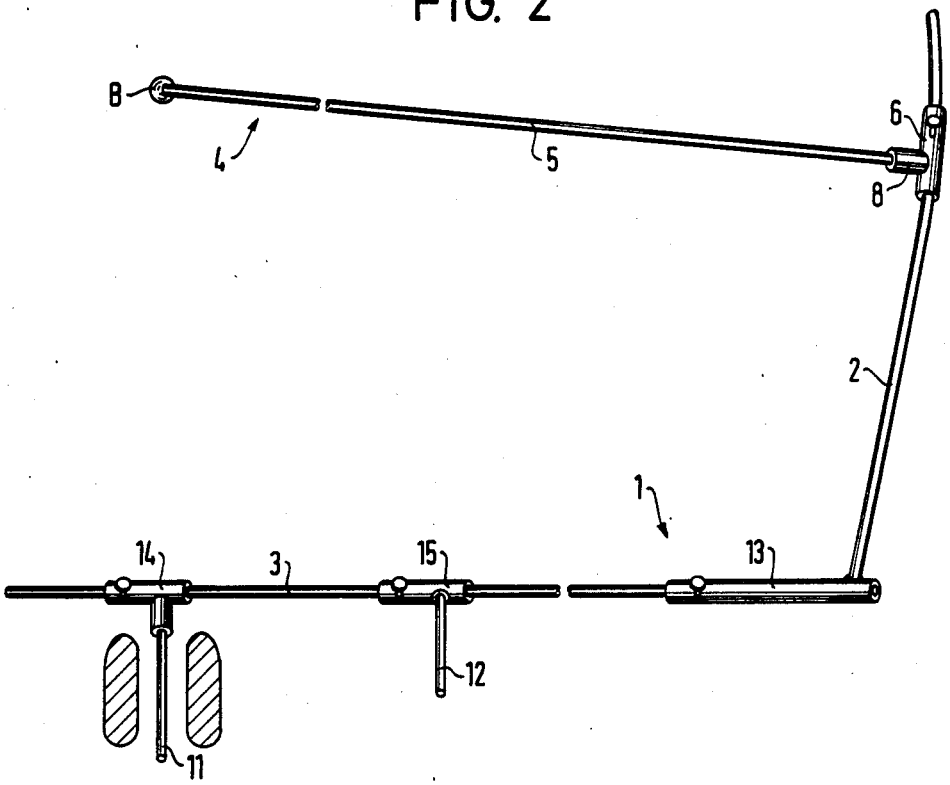
FIG. 2 is a top plan view, in part broken, of the training device of the present invention.

As will be seen from FIG. 2, the arcuate rod member 2 is fixedly joined to a tubular section or connecting sleeve 13 which receives the straight rod 3. The orientation stick 11 is fastened on the straight rod 3 by means of an arrestable sleeve 14 and may be slidably movable or fixed. Similarly, the knee stick 12 is fastened on the straight rod 3 by way of a sleeve 15 having arresting means thereon.

Figure 5:
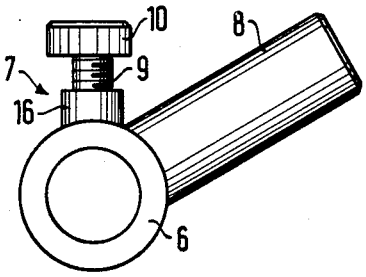
FIG. 5 is a front view of a sleeve of the training device of the present invention.
Figure 6:
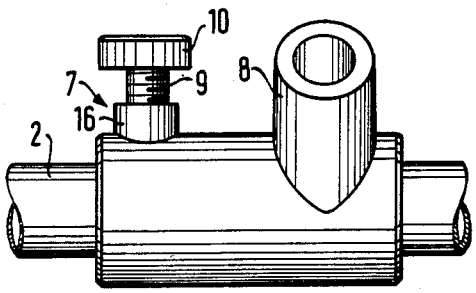
FIG. 6 is a side view of the sleeve of FIG. 5.

As also shown in FIG. 2, the barrier rail 5 is fastened onto the arcuate rod member 2 by means of fastening sleeve 6 having a cylindrical guide member 8 radially projecting therefrom. The sleeve 6 is shown in detail in FIGS. 5 and 6. It will be seen that the guide member 8 projects radially upwardly from the sleeve 6 and is disposed at an angle with respect to arresting means 7. The latter comprises an internally threaded collar 16 welded to the sleeve 6 and a screw threaded pin 9 with an operating knob 10. The pin 9 is screwed into the collar 16 on the sleeve 6 and is thus capable of coaction with the arcuate rod 2 to achieve detention of sleeve 6 including guide sleeve 8 thereon. The guide sleeve 8 is constructed to have its inner diameter correspond to the diameter of the barrier rail 5, thus enabling the barrier rail 5 to be simply slidably inserted into the guide sleeve 8.

Figure 4:
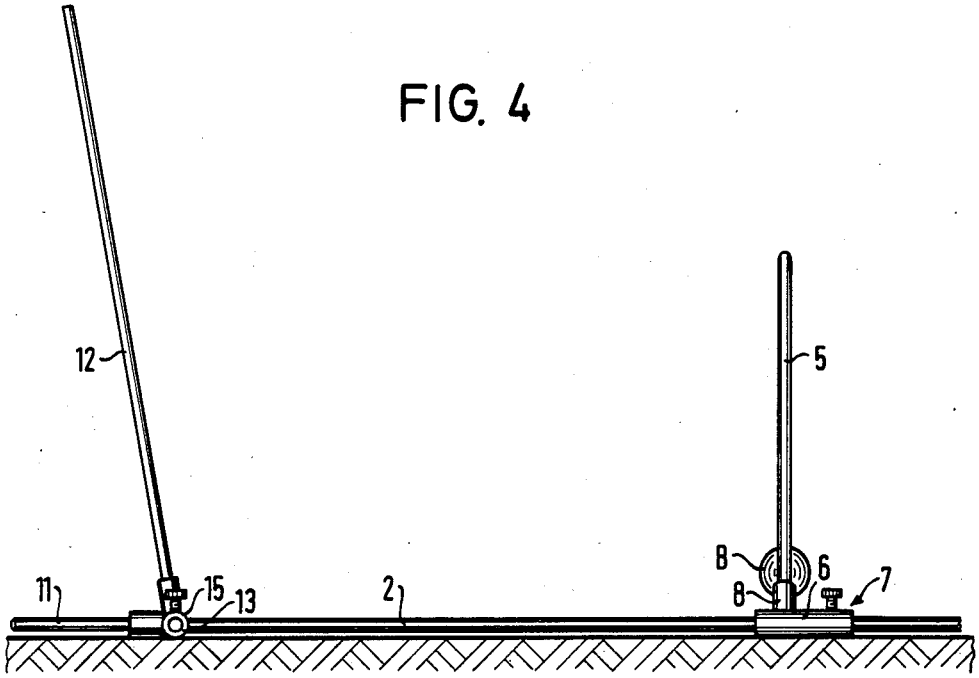
FIG. 4 is a rear view of the training device of the present invention.

FIG. 4 shows how the knee stick 12 is constructed to extend obliquely upwardly in order to bring about corrected swinging motion of the golfer.

Figure 3:
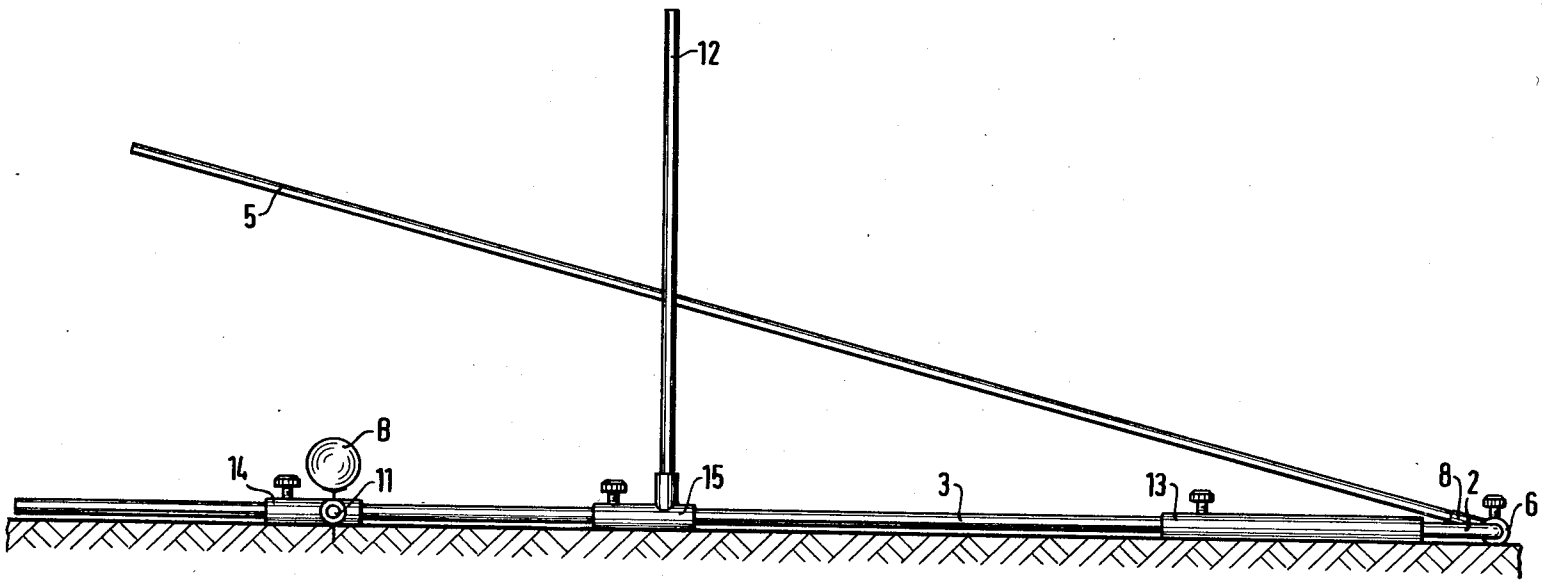
FIG. 3 is a side view of the training device of the present invention.

FIG. 3 specifically illustrates the angular position of the barrier rail 5. The angle of inclination of the barrier rail 5 is adjustable from the ground, depending on the needs to be met. The arcuate rod 2 is so constructed as to allow the barrier rail 5 to be pivoted upwardly by a maximum of approximately 10 degrees and downwardly by a maximum of approximately 20 degrees with respect to the target line Z.

The practice device according to the invention is placed, as it is shown in FIG. 1, so that the straight rod 3 is positioned on a straight line G which runs parallel to the target line Z. The barrier rail 5 is inserted into the guide sleeve 8 secured to the sleeve 6 mounted on the arcuate rod 2. Thereupon, a unit consisting of barrier rail 5 and sleeve 6 is slidably displaced along the arcuate rod 2 along the path designated I on which the club head is supposed to run. Failure of the golfer to execute the swing properly results in the club head striking the barrier rail 5 so that the golfer becomes immediately aware of his faulty motion. Thus, the barrier rail 5 defines a handicap and encourages the golfer to swing the club correctly at the ball, namely, from inside out. The advantage is that the club face is prevented from striking the ball from outside the target line.

It is also possible for the barrier rail 5 to be congruent with the target line Z and placed on the ground, whereby the guide sleeve 8 is positioned on the extrapolation of the target line Z. With this setup, the barrier rail 5 functions as an aid in target orientation rather than swing orientation.

The above-mentioned arresting means may be made of plastic moldings provided with set screws for fastening.

The construction and operation of the device as a whole is very simple and, due to the angular positioning of the barrier rail interacting with the arcuate rod, ensures proper execution of the golf swing.

We claim:

1. A training device for improving the golf swing of the type including a base and guide means for interaction with the face of a golf club head mounted and spatially positioned on said base, wherein said base comprises a first and a second rod member disposed at an angle to each other, said first rod member being arcuate and said second rod member being straight, and said guide means comprises a barrier rail mounted on said arcuate rod, said rail extending obliquely upward and delineating the upstroke of the golf swing.

2. A training device according to claim 1, wherein said rod members are hollow.

3. A training device according to claim 1, wherein said barrier rail is slidably mounted on said first, arcuate rod.

4. A training device according to claim 3, wherein said barrier rail is rotatable about the longitudinal axis of said arcuate rod.

5. A training device according to claim 2, further comprising a sleeve and arresting means on said sleeve, said sleeve being secured to said arcuate rod, and a guide sleeve for receiving said barrier rail, said guide sleeve mounted on and radially projecting from said fastening sleeve.

6. A training device according to claim 5, wherein said arresting means comprises a screw threaded pin having an operating handle thereon and which is inserted into said sleeve for interaction with said arcuate rod.

7. A training device according to claim 1, wherein said second straight rod has an orientation stick slidably attached thereto.

8. A training device according to claim 1, wherein said second straight rod has an upwardly extending knee stick obliquely and slidably attached thereon.

9. A training device according to claim 1, wherein said first arcuate rod is fastened to a connecting sleeve having said straight rod inserted therein.

* * * * *